US005908543A

United States Patent [19]

Matsunami et al.

[11] Patent Number: 5,908,543

[45] Date of Patent: Jun. 1, 1999

[54] METHOD OF ELECTROPLATING NON-CONDUCTIVE MATERIALS

[75] Inventors: Takashi Matsunami, Fujiidera; Masahiko Ikeda; Hiroyuki Oka, both of Daito, all of Japan

[73] Assignee: Okuno Chemical Industries Co., Ltd., Osaka, Japan

[21] Appl. No.: 08/973,098

[22] PCT Filed: Feb. 3, 1997

[86] PCT No.: PCT/JP97/00257

§ 371 Date: Dec. 9, 1997

§ 102(e) Date: Dec. 9, 1997

[87] PCT Pub. No.: WO98/33959

PCT Pub. Date: Aug. 6, 1998

[51] Int. Cl.[6] ..... C25D 5/54; C25D 5/56; C25D 5/34; B05B 3/10

[52] U.S. Cl. ..... 205/159; 205/164; 205/210; 427/98; 427/125; 427/304; 427/305; 427/306; 427/443.1; 106/1.05; 106/1.11

[58] Field of Search ..... 205/159, 164, 205/210; 427/98, 125, 304–306, 437, 443.1; 106/1.05, 1.11

[56] References Cited

U.S. PATENT DOCUMENTS

| | | | |
|---|---|---|---|
| 3,099,608 | 7/1963 | Radovsky et al. | 205/123 |
| 4,631,117 | 12/1986 | Minten et al. | 204/15 |
| 4,683,036 | 7/1987 | Morrissey et al. | 204/15 |
| 4,810,333 | 3/1989 | Gulla et al. | 204/15 |
| 4,895,739 | 1/1990 | Bladon | 427/304 |
| 4,919,768 | 4/1990 | Bladon | 204/15 |
| 5,007,990 | 4/1991 | Bladon | 204/15 |
| 5,071,517 | 12/1991 | Oabayashi | 205/50 |
| 5,342,501 | 8/1994 | Okabayashi | 205/50 |
| 5,543,182 | 8/1996 | Joshi et al. | 427/443.1 |

FOREIGN PATENT DOCUMENTS

| | | |
|---|---|---|
| 3-1381 | 1/1991 | Japan . |
| 6-510568 | 11/1994 | Japan . |
| 7-9078 | 2/1995 | Japan . |
| 7-197266 | 8/1995 | Japan . |
| 8-209354 | 8/1996 | Japan . |
| WO 89/08375 | 9/1989 | WIPO . |
| WO 93/00456 | 1/1993 | WIPO . |

*Primary Examiner*—Kathryn Gorgos
*Assistant Examiner*—Edna Wong
*Attorney, Agent, or Firm*—Armstrong, Westerman, Hattori, McLeland and Naughton

[57] ABSTRACT

This invention provides a method of electroplating a non-conductive material, the method comprising the steps of bringing a non-conductive material into contact with an acidic hydrosol solution containing a palladium compound, a stannous compound and a copper compound, bringing the material into contact with an aqueous alkaline solution, and electroplating the material. According to the method of the invention, a desired coating having an excellent decorative appearance can be formed by electroplating without involving electroless plating on even a non-conductive material having a large area such as plastic molded components.

6 Claims, No Drawings

METHOD OF ELECTROPLATING NON-CONDUCTIVE MATERIALS

This is a national stage application of PCT/JP97/00257 filed Feb. 3, 1997.

FIELD OF THE INVENTION

The present invention relates to a method of electroplating the surface of non-conductive materials without involving electroless plating.

PRIOR ART

Various methods are known for plating non-conductive materials such as plastics for decorating purposes or for function-imparting purposes.

Electroless plating methods are commonest for such purposes. Methods industrially available include a method comprising applying Pd-Sn catalyst nuclei onto a substrate of plastics, typically ABS resins, to be electroplated, treating the substrate with a diluted acidic solution, forming an electroconductive metal coating using an electroless copper plating solution or an electroless nickel plating solution, and then electroplating the substrate.

However, electroless plating methods necessitate complicated pretreatments. Further an etectroless plating solution his a drawback that a complicated procedure is involved to strictly control the bath because of its intensive self-decomposing property. In addition, when an electroless copper plating solution is used, various problems arise. For example, highly toxic formalin, i.e. a carcinogen, is widely used as a reducing agent. Moreover, a highly effective complexing agent such as EDTA or the like is used to solubilize copper ions in an alkali solution. In using the complexing agent, considerable labor is entailed for removal of metal ions in disposal of waste water, and a prolonged period of time is taken for the formation of even a very thin copper coating. When an electroless nickel plating solution is used, hypophosphite used as a reducing agent is converted to phosphite on oxidation. The obtained phosphite is legally controlled for regulation of phosphorus. Further, the electroless nickel plating solution is raising an environmental pollution problem as a high COD waste liquor.

In the current situation, it has been reported to carry out a variety of pretreatments prior to electroplating in methods for electroplating a non-conductive material without involving electroless plating. For example, the proposed pretreatment methods include a method treating a substrate with a palladium-tin solution, a method forming an organic electroconductive coating and a method applying carbon black (U.S. Pat. Nos. 3,099,608; 4,683,036; 4,895,739; 4,919,768; 5,007,990; and 4,810,333; Japanese Examined Patent Publication No. 1,381/1991 and International Publication Wo 89/08,375).

However, these methods mostly produce coatings of low electroconductivity and are used for limited applications due to a low depositing rate in electroplating. The methods, for example, are limited to a purpose of electroplating through holes of thin printed boards. In most cases, the methods entail difficulty in forming a desirable coating by electroplating on plastic molded articles having a large area. Further, the methods pose problems of forming an electroplated coating of low adhesion and poor covering power, namely can not assure formation of reliable coating.

In recent years, various researches have been conducted on methods of electroplating non-conductive materials. For example, the following methods have been reported.

U.S. Pat. No. 5,071,517 discloses a method comprising treating a substrate with an aqueous solution of a non-acidic salt containing a dispersion of fine colloids of precious metal and tin to form an electroconductive layer, followed by electroplating. U.S. Pat. No. 5,342,501 discloses a method comprising treating a substrate with a non-acidic tin-palladium catalyst and then with a promoter solution of low basicity to improve the electroconductivity.

U.S. Pat. No. 5,543,182 discloses a method comprising bringing a non-conductive substrate into contact with an activating agent containing a precious metal/IVA Group metal sol and treating the substrate with a solution containing a soluble salt of a metal which is more precious than IVA Group metal, a hydroxide of IA Group metal and a specific complexing agent to form a metallic coating.

Japanese Unexamined Patent Publication No. 197266/1995 discloses a method comprising applying a copper catalyst containing a cuprous oxide colloid to the surface of a non-conductive substrate, immersing the substrate into a solution containing a reducing agent for copper or into an inorganic acid solution to form a electroconductive coating, and electroplating the substrate.

Japanese Unexamined Patent Publication No. 209354/1996 discloses a method comprising introducing an acidic group to the surface of resin substrate, immersing the substrate into a solution containing metal ions to adsorb the metal ions thereon and conducting reduction treatment or the like to impart electroconductivity to the surface of the resin substrate.

DISCLOSURE OF THE INVENTION

It is a primary object of the present invention to provide a novel method, which is different from the foregoing prior art methods, capable of electroplating a non-conductive material without involving electroless plating step, and capable of forming a desirable coating excellent in decorative exterior by electroplating even a material having a large area such as plastic molded articles.

The present inventors conducted extensive research in view of the foregoing state of the prior art and found out a method which comprises the steps of bringing a non-conductive material into contact with an acidic hydrosol solution containing a palladium compound, a stannous compound and a copper compound, bringing the material into contact with an aqueous alkaline solution to form an electroconductive coating on the surface of the material, and electroplating the material. When this method is carried out, even a material having a large area such as plastic molded components can be electroplated to give a coating superior in decorative appearance. The present invention was completed based on this novel finding.

According to the present invention, there is provided a method of electroplating a non-conductive material, the method comprising the steps of bringing a non-conductive material into contact with an acidic hydrosol solution containing a palladium compound, a stannous compound and a copper compound, bringing the material into contact with an aqueous alkaline solution, and electroplating the material.

Non-conductive materials to be treated in the present invention are not specifically limited and include, for example, plastics, ceramics, glasses, composite materials thereof, etc. According to the method of the present invention, large-size substrates of great surface area which have been difficult to electroplate by a simple procedure without electroless plating can be readily electroplated to give a desired coating superior in decorative appearance. For example, large-size materials to be treated in the present invention include plastic components which are currently widely employed in the automotive industry and the like. Examples of such large-size plastic materials are front grilles, emblems and like automotive parts, exterior parts of electronic apparatus, knobs and like parts to be electroplated for decorations, materials to be electroplated for giving corrosion resistance and for adding a new function, etc.

The kind of plastics to be used is not specifically limited, and includes various plastics heretofore known. Examples are general-purpose plastics heretofore extensively used for chemical plating such as ABS resins, general-purpose engineering plastics having a heat resistance at 150° C. or less, such as polyamides (nylon PA), polyacetals (POM), polycarbonates (PC), modified polyphenylene ethers (PPE), polybutylene terephthalates (PBT) and the like, super engineering plastics having a heat resistance at 200° C. or more, such as polyphenylene sulfides (PPS), polyether sulfones (PES), polyether imides (PEI), polyether ether ketones (PEEK), polyimides (PI), liquid crystal polymers (LCP) and the like, polymer alloys such as polycarbonate/ABS resins and the like. Among these plastics, preferred are plastics of a grade suitable for plating such as ABS resins and the like which can avoid the decrease of adhesion and the degradation of appearance when etched or otherwise pretreated.

Specific examples of plastics materials to be used for automotive components are molded articles made of ABS resins, polyamide resins or the like, such as automotive emblems made of ABS resins, automotive door handles made of polyamide resins (nylons), etc.

Successively described below are the steps in the treatment method of the present invention when, for example, plastics materials are used for treatment. Although water washing is usually carried out between two consecutive steps, reference to washing is omitted herein.

Pretreatment

First, the surface of a substrate to be treated is cleaned to remove deposits such as fingerprints, fats and oils and like organic substances, dust deposited due to electrostatic action and so on. Conventional degreasing agents can be used as a treating solution. Degreasing and other treatments are conducted in the conventional manner using, for example, an alkaline degreasing agent or the like.

Subsequently the surface of the substrate to be treated is etched when so required. The etching treatment selectively dissolves the surface of resin substrate to achieve an anchor effect. This treatment can improve the adhesion of the electroplated coating and the appearance of the coating surface. The etching procedure is carried out by conventional methods. For example, the substrate to be treated is immersed in a properly h)eated mixed solution of chromic acid and sulfuric acid. When a substrate of ABS resin is treated, the etching treatment dissolves out butadiene rubber as a constituent due to oxidative effect of chromic acid, giving anchor pores of about 1 to about 2 $\mu$m in pore size on the resin substrate, while the butadiene is caused to undergo oxidative decomposition, producing a polar group such as a carbonyl group. Consequently a hydrosol of three elements, Pd-Cu-Sn, is easily adsorbed in the subsequent step.

When substrates of general-purpose engineering plastics or super engineering plastics are treated, they are often difficult to etch and, therefore, are pre-etched in the conventional manner prior to etching, when so required. The pre-etching treatment swells a skin layer or a crystal-orientated layer on the surface of a resin substrate using an organic solvent. The pre-etching can be conducted usually using a solvent of high polarity such as dimethyl sulfoxide. The pre-etching treatment can enhance the etching effect.

Also, resin substrates containing inorganic materials, glass fibers and the like can be treated by conducting a proper etching method selected from conventional methods.

After etching, the resin substrate is washed to remove the etching solution such as chromic acid or the like remaining on the surface of resin substrate. The chromic acid can be easily removed from the surface when cleaning is effected using a diluted solution of hydrochloric acid or a solution containing a reducing agent such as sodium bisulfite.

Treatment with an acidic hydrosol solution

After pretreatment, the substrate to be treated is brought into contact with an acidic hydrosol solution containing a palladium compound, a stannous compound and a copper compound. Usually the substrate to be treated is immersed in the acidic hydrosol solution. Before treatment with the acidic hydrosol solution, a pre-dip treatment may be carried out, when required, by dipping the substrate in an aqueous solution of hydrochloric acid to improve the stability of the acidic hydrosol solution and the adhesion of the obtained acidic hydrosol layer. Useful aqueous solutions of hydrochloric acid include, for example, an aqueous solution of about 150 to about 400 ml/l of 35% hydrochloric acid.

Examples of the palladium compound to be incorporated into the acidic hydrosol solution are palladium chloride, palladium sulfate, palladium acetate and the like. These compounds are used either alone or in combination. The amount of the palladium compound is preferably about 0.1 to about 1.0 g/l, more preferably about 0.2 to about 0.5 g/l, calculated as a palladium metal. The amount of less than 0.1 g/l can not give sufficient electroconductivity, whereas the amount of above 1.0 g/l can not further enhance the electroconductivity, and hence is uneconomical.

Preferred examples of the stannous compound to be used are stannous chloride, stannous sulfate and the like. These compounds can be used either alone or in combination. Among them, stannous chloride is preferable. A stannous compound needs to be used in excess relative to a palladium compound. The amount of the stannous compound is about 5 g/l or more, calculated as a tin metal. A weight ratio of Sn/Pd is preferably about 50–200:1, more preferably about 60–120:1. If the weight ratio of Sn/Pd is less than 50:1, a reduced depositability is shown in electroplating, whereas if the weight ratio of Sn/Pd is more than 200:1, a rough-surfaced coating is obtained by electroplating, namely a degraded appearance is imparted to the coating. Hence the weight ratio of Sn/Pd outside said range is undesirable.

Preferred copper compounds are copper lower aliphatic monocarboxylate, copper bromide and so on. These compounds can be used either alone or in combination. Among copper compounds, divalent copper compounds are preferred because of their high solubility. Preferred copper lower aliphatic monocarboxylate are copper formate, copper acetate and the like. When these compounds are used, a stable hydrosol is formed, and can be easily deposited as a uniform hydrosol layer on the substrate.

The amount of the copper compound is preferably about 0.2 to about 3 g/l, more preferably about 0.5 to about 2 g/l, calculated as a copper metal. If less than 0.2 g/l of copper metal is used, it is difficult to form a homogeneous electroconductive film, whereas if more than 3 g/l thereof is used, a hydrosol solution is unstable and readily decomposes. Hence the amount of a copper metal outside said range is undesirable.

The acidic hydrosol solution to be used in the invention essentially comprises the three components among which a stannous compound is contained in large excess. In a solution having such composition, a redox reaction stoichiometrically occurs as shown below in the formulae (1) and (2). In the reaction, presumably divalent palladium ions are made into a palladium metal by reduction with a divalent tin, and when the solution contains divalent copper ions, the copper ions are converted to monovalent copper ions, whereby a stable hydrosol solution is formed.

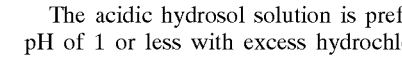

$$Pd^{2+}+Sn^{2+}\rightarrow Pd^{0}+Sn^{4+} \quad (1)$$

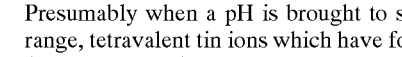

$$Cu^{2+}+Sn^{2+}\rightarrow Cu^{1+}+Sn^{4+}e^{-1} \quad (2)$$

The acidic hydrosol solution is preferably adjusted to a pH of 1 or less with excess hydrochloric acid. When the solution is made strongly acidic, precipitation is prevented. Presumably when a pH is brought to such a strong acidity range, tetravalent tin ions which have formed α-stannic acid ($H_2SnO_3.6H_2O$) are prevented from precipitation as metastannic acid ($H_2Sn_5O_{11}$) or tin oxide ($SnO_2$).

In the treatment with the acidic hydrosol solution, the substrate to be treated is immersed in the hydrosol solution at about 10 to about 50° C., preferably about 25 to about 40° C. for about 2 to about 10 minutes, preferably about 3 to about 5 minutes.

The treatment forms a homogeneous hydrosol layer on the surface of the substrate.

Treatment with an aqueous alkaline solution

Next, the substrate to be treated is brought into contact with an aqueous alkaline solution. Usually the substrate to be treated is immersed in the aqueous alkaline solution. Then the hydrosol layer uniformly formed on the surface of the substrate is caused to firmly adhere to the surface of plastic substrate as an electroconductive dense gel.

Presumably a disproportionation reaction represented by the formula (3) is brought about on contact of the hydrosol layer with the aqueous alkaline solution to produce a copper metal from monovalent copper ions which metal firmly adheres to the surface of the substrate.

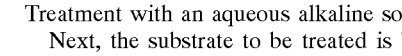

$$Cu^{1+}+Cu^{1+}\rightarrow Cu^{0}+Cu^{2+} \quad (3)$$

It is presumed that concurrently with this reaction, excess α-stannic acid ($H_2SnO_3.6H_2O$) surrounding the palladium and copper hydrolyzes and adheres as a stable tin oxide, contributing to the increase of electroconductivity, while the tin oxide adhering in excess is removed as a sodium stannate ($Na_2SnO_3$) or like soluble alkali salt of stannic acid.

An aqueous alkaline solution is preferably prepared using an alkali metal hydroxide such as sodium hydroxide, potassium hydroxide, lithium hydroxide or the like either alone or in combination.

It is desirable that the aqueous alkaline solution be adjusted to a pH of 12 or higher. If the pH is lower than 12, the tin oxide adhering in excess can not be satisfactorily removed, thereby tending to impair the appearance of the coating to be formed by electroplating. Hence it is undesirable.

Further, when required, the aqueous alkaline solution may contain a complexing agent for tin, such as hydroxycarboxylic acids, e.g. tartaric acid, citric acid and the like, alkanolamines, e.g. monoethanolamine, diethanolamine, triethanolamine and the like. When these complexing agents are used, the dissolved sodium stannate is prevented from hydrolyzing to an insoluble tin hydroxide. A preferred amount of the complexing agent to be used is about 2 to about 40 g/l.

The alkali metal-containing aqueous solution may contain, when required, at least one compound selected from the group consisting of divalent copper compounds and palladium compounds. When these compounds are added, the obtained electroconductive coating is imparted a reduced resistance. Examples of useful divalent copper compounds are cupric sulfate, cupric chloride, cupric nitrate, cupric acetate, cupric formate and the like. Useful palladium compounds include, for example, palladium chloride, palladium sulfate and the like. The amount of at least one compound selected from the group consisting of divalent copper compounds and palladium compounds to be used is-preferably about 0.2 to about 5 g/l.

At least one compound selected from the group consisting of divalent copper compounds and palladium compounds is preferably used along with the complexing agent. The conjoint use of these compounds can inhibit the production of insoluble hydroxides of copper or palladium.

The aqueous alkaline solution may further contain, when required, a reducing agent such as hydrazine, sodium boron hydride, sodium thiosulfate, sodium ascorbate, vanillin, sucrose and so on. On addition of these reducing agents, the palladium and copper present in the hydrosol layer can be quickly metallized. The amount of the reducing agent to be used may be very small and is preferably about 0.2 to about 3 g/l.

Insofar as preservation of the environment is concerned, it is desirable to avoid the use of a complexing agent, hydrazine and the like.

For the treatment with the aqueous alkaline solution, the substrate to be treated is immersed in the aqueous alkaline solution at about 25 to about 70° C., preferably about 45 to about 60° C. for about 2 to about 10 minutes, preferably about 3 to about 5 minutes.

This treatment causes the hydrosol layer on the surface of the substrate to firmly adhere to the surface thereof as an electroconductive dense gel, thereby forming an electroconductive layer. Electroplating can be performed directly on said electroconductive layer in the subsequent step.

Observation under a transmission type electron microscope (TEM) and analysis with an X-ray photoelectron spectrometer (XPS) show that the electroconductive layer thus obtained is a dense, thin film containing, as main components, a palladium metal, a copper metal and a tin oxide and having a thickness of about 50 to about 150 Å.

The electroconductive layer has a specific resistance of about 10 to about 300 KΩcm, namely a relatively high resistance as compared with a specific resistance of about 2 to about 50 Ωcm exhibited by a deposit of about 0.5 μm thickness, the deposit being given by electroless nickel plating. It is presumably for the following reasons that a desired layer is formed by electroplating directly on the electroconductive layer despite its relatively high resistance value.

At contact points of the jig for use in electroplating, i.e. at its electric supply portion, an active metal such as palladium or the like exists on the surface of an electroconductive layer which is contacted with a jig. Consequently, a deposition potential at contact points is low so that an electric current flows through the electroconductive layer of such low potential. Since the electroconductive layer has a relatively high resistance, the current efficiency is low. Thus a hydrogen gas is evolved to reduce and activate the electroconductive layer, thereby promoting the electrodeposition of a metal. Further, presumably the tin oxide in the electroconductive layer facilitates the acceptance of electrons on the coating surface at a relatively low electric potential of about 0.5 to about 3 V due to its semiconducting property, thereby mediating electric current. In addition, probably the copper metal in the electroconductive layer has such high conductivity as to lower the resistance. It is considered that the combined activities of these components facilitate electroplating on the electroconductive layer, causing rapid formation of a coating by electroplating over the entire surface of even a substrate having a relatively large area.

Electroplating

Subsequently the substrate thus treated is electroplated in the conventional manner. Useful electroplating baths are not specifically limited and can be any of conventional electroplating baths. The electroplating conditions can be conventional.

Electroplating methods for a decoration purpose comprising successively electroplating a substrate with copper, nickel and chrome in this order are specifically described below as an example of electroplating methods.

A conventional bright copper sulfate plating solution can be used as a copper sulfate plating solution. For example, a plating bath to be used in the invention is prepared by mixing a conventional brightener with an aqueous solution containing about 100 to about 250 g/l of copper sulfate, about 20 to about 120 g/l of sulfuric acid, and about 20 to about 70 ppm of chlorine ions. Copper sulfate plating conditions may be conventional. For example, electroplating is conducted at a plating solution temperature of about 25° C. and a current density of about 3 A/dm$^2$ and is continued until a deposit of the predetermined thickness is obtained.

A usual Watts bath can be used as a nickel plating solution. Useful baths are prepared by adding a commercially available brightener for a nickel plating bath to an aqueous solution containing about 200 to about 350 g/l of nickel sulfate, about 30 to about 80 g/l of nickel chloride and about 20 to about 60 g/l of boric acid. Nickel plating conditions may be conventional. For example, electroplating is conducted at a plating solution temperature of about 55 to about 60° C. and a current density of about 3 A/dm$^2$ and is continued until a coating of the predetermined thickness is obtained.

A usual Sargent bath can be used as a chrome plating solution. Useful baths include an aqueous solution containing about 200 to about 300 g/L of chromic anhydride and about 2 to about 5 g/l of sulfuric acid. Chrome plating conditions are, for example, a plating solution temperature of about 45° C. and a current density of about 20 A/dm$^2$, and the electroplating is continued until a deposit of the predetermined thickness is obtained.

According to the present invention, a desired coating can be formed by electroplating various non-conductive materials. Especially the method of the invention is advantageous in that a coating with superior decorative appearance can be easily formed by electroplating on an insulating component having a large area such as plastic molded components. Such plastic molded products of large area are electroplated usually using a jig having contact points spaced away by a wide distance of about 50 to about 150 mm. According to conventional treatment methods, it was difficult to obtain a superior coating over the entire surface of a substrate by electroplating. However, according to the method of the invention, even a substrate with a large area can be electroplated over its entire surface in a short time at an initial electroplating stage presumably due to the action of the components in the electroconductive layer as described above, and thus a superior coating can be formed by electroplating.

According to the method of the present invention, the obtained coating has not only a superior appearance but a high adhesion to the substrate. Especially when electroplating is conducted according to the invention on a properly etched resin article or a substrate of ceramic material having a suitable surface roughness, a coating of high adhesion can be formed by electroplating. For example, the obtained coating is generally higher in adhesion by about 0.3 kg/cm than coatings obtained by conventional methods of electroplating after electroless plating. One of reasons for this difference is presumably as follows. The electroconductive layer formed by the method of the present invention is about 50 to about 150 Å thick, namely very thin and is homogeneous and dense. The thin layer is formed even on the dents and projections of the substrate surface made irregular by etching or like treatment, whereby the thin layer is made to firmly adhere to the substrate. Thereafter the surface of the layer is electroplated to give a coating sticking to the dents and projections, whereby a high adhesion is attained.

Moreover, the coating formed by electroplating according to the present invention is substantially free of exterior flaws such as a rough surface, stardust-like parts and the like, is excellent in decorative appearance and has a high corrosion resistance compared with coatings formed by electroplating after electroless plating.

The reason why the coating formed by the electroplating method of the present invention has superior properties remains to be clarified, but is presumably that because a desirable coating is formed without performing electroless plating, the disadvantages associated with electroless plating may be obviated.

BEST MODE FOR CARRYING OUT THE INVENTION

The present invention is further clarified with reference to the following examples.

EXAMPLE 1

A substrate to be treated is an automotive emblem made of an ABS resin (product of Mitsubishi Rayon Co., Ltd., trade name "3001 M") which has a length of 17 cm, a width of 3.8 cm, a thickness of 0.3 cm and a surface area of about 1.3 dm$^2$. A jig for use in electroplating had two contact points for contact with the substrate to be treated, the two contact points being spaced away by 11 cm. The contact point portion was a stainless steel rod having a diameter of 2 mm. The other portion of the jig than the contact points was coated with a layer formed by baking a vinyl chloride sol.

The substrate to be treated was held by the jig and immersed in a solution of alkaline degreasing agent (product of Okuno Chemical Industries Co., Ltd., trade name "ACE CLEAN A-220", aqueous solution containing 50 g/l of the product) at 50° C. for 5 minutes, washed with water and immersed in, as an etching solution, an aqueous solution containing 400 g/l of chromic anhydride and 400 g/l of sulfuric acid at 67° C. for 10 minutes to give a rough surface. Thereafter the substrate to be treated was washed with water, immersed in an aqueous solution containing 50 ml/l of 35% hydrochloric acid and 10 ml/l of a reducing agent (product of Okuno Chemical Industries Co., Ltd., trade name "TOP CATCH CR-200") at 25° C. for 1 minute to remove the chromic acid from the surface of resin substrate, and washed well with water.

Then, a pre-dip treatment was carried out by dipping the substrate into an aqueous solution containing 250 ml/l of 35% hydrochloric acid at 25° C. for 1 minute. Thereafter the substrate was immersed in a strongly acidic hydrosol solution (weight ratio of Sn/Pd of 80.5:1) containing 0.32 g/l of palladium chloride (0.19 g/l of Pd), 29 g/l of stannous chloride (15.3 g/l of Sn) and 1.5 g/l of cupric acetate (0.5 g/l of Cu) and having a pH adjusted to 1 or less with 300 ml/l of 35% hydrochloric acid, at 40° C. for 5 minutes to deposit a homogeneous hydrosol layer on the surface of tile resin substrate.

Subsequently the substrate was washed with water and immersed in an aqueous alkaline solution containing 50 g/l of sodium hydroxide and having a pH of 12 or more at 50° C. for 5 minutes to gel the hydrosol layer deposited in the preceding step, whereby a firm electroconductive layer was formed.

The substrate was then washed well with water and was transferred to the subsequent copper electroplating step using the same jig.

A copper plating solution was prepared by mixing an aqueous solution containing 200 g/l of copper sulfate, 50 g/l of sulfuric acid and 50 mg/l of chlorine with, as a brightener, 5 ml/l of "ELECOPPER II MU" and 1 ml/l of "ELECOPPER II A" (trade names, products of Okuno Chemical Industries Co., Ltd.). A copper electroplating procedure was conducted at a plating solution temperature of 25° C. and a current density of 3 A/dm$^2$ using a plate of phosphorus-containing copper as an anode and the substrate to be plated as a cathode while effecting slow air agitation. Fifty seconds after initiation of electroplating, the substrate was electroplated over the entire surface. The electroplating was continued for 50 minutes to give a coating of about 30 $\mu$m thickness.

Next, the coated substrate was washed with water and immersed in a solution of an activating agent (product of Okuno Chemical Industries Co., Ltd., trade name "TOP SAN", aqueous solution containing 50 g/l of the product) at 25° C. for 1 minute to activate the substrate. Then the substrate was washed well with water and electroplated with nickel. A nickel plating solution was prepared by mixing an aqueous solution containing 280 g/l of nickel sulfate, 50 g/l of nickel chloride and 40 g/l of boric acid with 20 ml of "ACNA B-1" and 1 ml/l of "ACNA B-2" (trade names, products of Okuno Chemical Industries) as a brightener. Nickel electroplating was conducted at a plating solution temperature of 55° C. and a current density of 3 A/dm2 for 20 minutes using a plate of pure nickel as an anode and the substrate to be plated as a cathode while effecting slow air agitation. A nickel coating of about 10 $\mu$m thickness was formed.

Thereafter, the substrate was washed with water and chrome electroplating was carried out. A chrome plating solution was an aqueous solution containing 250 g/l of chromic anhydride and 2.5 g/l of sulfuric acid. Using a lead plate as an anode and the substrate to be plated as a cathode, chrome electroplating was conducted at a plating solution temperature of 45° C. and a current density of 20 A/din$^2$ for 3 minutes without agitation.

The obtained coating was uniform in a low current density portion as well as a high current density portion, and was substantially free of pits, a rough surface and other flaws, glossy and excellent in appearance.

Examples 2 to 8 and Comparative Examples 1 and 2

A substrate to be treated was a plate-shaped test piece of ABS resin (product of SUMIKA A & L CO., LTD., trade name "CLARASTICK AP-8A") measuring 10 cm in width, 15 cm in length and 0.3 cm in thickness and having a surface area of 3.2 dm$^2$. A jig for use in electroplating had 4 contact points for contact with the substrate, the contact points being spaced away by 5 cm (2 locations) and by 7 cm (2 locations). The contact point portion was a stainless steel rod 2 mm in diameter.

The same procedure as in Example 1 was repeated until the pre-dip treatment was done. Then the substrate was immersed in an acidic hydrosol solution having each composition as shown in Table 1 at a solution temperature of 40° C. for 5 minutes. The substrate was washed well with water, immersed in an aqueous alkaline solution containing 45 g/l of sodium hydroxide at a pH of 12 or more at 50° C. for 5 minutes, and washed with water.

Thereafter, a copper electroplating procedure was conducted using the same copper sulfate plating solution as used in Example 1 at a plating solution temperature of 25° C. and a current density of 3 A/dm$^2$. One minute later, the substrate was taken out from the plating solution to evaluate a covering ratio of the copper coating. Also determined was a deposition ratio of three metals in the electroconductive layer on the test piece coated over its entire surface.

Apart from the above covering test, a copper electroplating procedure was carried out at a current density of 3 A/dm$^2$ for 50 minutes. The appearance of the plated substrate was evaluated by the following method. The adhesion of copper coating and the conductivity of the electroconductive layer were also assessed by the following methods.

The test results are shown in Tables 2 and 3.

Measuring methods

*1) Covering ratio: When a test piece was coated over the entire surface by copper plating, it was rated as 100%.

*2) Metal deposition ratio: A test piece was dried after formation of electroconductive layer and immersed in a solution of aqua regia (a mixed solution of hydrochloric acid and nitric acid at a volume ratio of the former:the latter of 3:1) at 25° C. to completely dissolve the electroconductive layer. Then the amount of three elements, Pd, Sn and Cu was measured with a plasma emission spectrophotometer (product of Seiko Instruments Inc., trade name "SPS 4000"). The deposition ratio was expressed in terms of a weight ratio of elements.

*3) Appearance of coating: The appearance of the copper coating was visually inspected and evaluated according to the following criteria.

A: Free of pits and rough surface

B: Slightly rough surface occurred

C: Rough surface occurred

*4) Adhesion: Copper sulfate electroplating was conducted at a temperature of 25° C. and a current density of 3 A/dm$^2$ for 90 minutes. Thereafter the coated test piece was dried at 80° C. for 120 minutes, left to stand at room temperature and cut to the substrate to give cuts of 10 mm width. The coating was pulled vertically of the resin surface using a tensile tester (product of Shimadzu Corp., "AUTOGRAPH SD-100-C") to measure the peel strength thereof. The peel strength shown in Tables 2 and 3 is an average of measured values obtained at 3 points.

*5) Electroconductivity: After formation of electroconductive layer, the coated substrate was washed with water and dried to measure a specific resistance using a digital multi-meter (product of YOKOGAWA HEWLETT PACKARD CO, LTD.).

TABLE 1

| | Example | | | | | | | Com. Ex. | |
|---|---|---|---|---|---|---|---|---|---|
| Compound (g/l) | 2 | 3 | 4 | 5 | 6 | 7 | 8 | 1 | 2 |
| Palladium chloride | 0.5 | | | 0.3 | 0.5 | 0.5 | | 0.5 | |
| Palladium sulfate | | 0.4 | | | | 1.0 | | | 1.5 |
| Palladium acetate | | | 1.1 | 0.4 | | | 2.1 | | |
| Stannous chloride | 34.2 | 27.0 | 114 | 60.8 | 108 | 76.0 | 181 | 34.2 | 32.0 |
| Cupric formate | 1.2 | | | | 1.5 | | 1.2 | | |
| Cupric acetate | | | 1.1 | 4.3 | | 2.3 | | | 1.1 |
| Cupric bromide | | 3.5 | | | 0.4 | 7.0 | 0.6 | | |
| Pd | 0.3 | 0.2 | 0.5 | 0.4 | 0.3 | 0.8 | 1.0 | 0.3 | 0.8 |
| Cu | 0.5 | 1.0 | 0.4 | 1.5 | 0.8 | 2.8 | 0.9 | | 0.4 |
| Sn/Pd (Weight ratio) | 60:1 | 70:1 | 120:1 | 80:1 | 190:1 | 50:1 | 95:1 | 60:1 | 40:1 |
| pH | Not higher than 1 | | | | | | | | |

TABLE 2

| | Example | | | | | | |
|---|---|---|---|---|---|---|---|
| Test item | 2 | 3 | 4 | 5 | 6 | 7 | 8 |
| Covering ratio (%) | 100 | 98 | 100 | 100 | 100 | 100 | 100 |
| Pd amount (mg/dm$^2$) | 0.32 | 0.25 | 0.38 | 0.41 | 0.28 | 0.80 | 0.90 |
| Deposition ratio (Pd:Sn:Cu) | 7:5:1 | 5:6:1 | 6:6:1 | 4:3:1 | 4:15:1 | 7:3:1 | 5:6:1 |
| Appearance | A | A | A | A | B | A | A |
| Peel strength (kg/cm) | 1.5 | 1.6 | 1.7 | 1.6 | 1.5 | 1.7 | 1.5 |
| Specific resistance (Ωcm) | 40K | 120K | 30K | 70K | 300K | 30K | 20K |

TABLE 3

| | Comparative Example | |
|---|---|---|
| Test Item | 1 | 2 |
| Covering ratio (%) | 0 | 10 |
| Pd amount (mg/dm$^2$) | 0.41 | 0.20 |
| Deposition ratio (Pd:Sn:Cu) | — | — |
| Appearance | — | — |
| Peel strength (kg/cm) | — | — |
| Specific resistance (Ωcm) | Infinite | 35M |

COMPARATIVE EXAMPLE 3

The same procedures as in Examples 2–8 were repeated using the same substrate and the same jig until the pre-dip treatment was done.

Then the substrate was immersed in a catalyst solution containing 0.5 g/l. of palladium chloride and 34.2 g /l of stannous chloride at a solution temperature of 30° C. for 5 minutes, washed with water, immersed in an acidic accelerator solution containing 150 g/l of sulfuric acid at a solution temperature of 25° C. for 3 minutes and washed well with water Next, a copper chemical plating solution (product of Okuno Chemical Industries Co., Ltd., trade names "CHEMICAL COPPER 500 A" and "CHEMICAL COPPER 500 B", aqueous solution containing 125 ml/l of the former product and 125 ml/l of the latter) was prepared. Chemical copper plating was conducted at a solution temperature of 25° C. for 17 minutes while effecting slow air agitation in a manner to bring the test piece out of contact with the air. The procedure gave an electroless copper coating of about 0.6 μm thickness.

Thereafter copper electroplating was carried out in the same manner as in Example 1. The obtained copper coating had a rough surface and an unsightly appearance. The coating had a tensile strength of 1.2 kg/cm and showed a lower adhesion than the coatings formed in Examples 2–8.

EXAMPLE 9

A component for a gas water heater was used as a substrate to be treated. The component was 6 cm in radius, 1.2 cm in thickness and about 1 dm$^2$ in surface area, was made of a polycarbonate resin (product of GE Plastics Japan, Ltd., trade name "LEXAN 910 A") and had a cylindrical shape. A jig used in electroplating had two contact points to be contacted with the substrate and spaced away by 3 cm. The contact point portion was a stainless steel rod 2 mm in diameter.

For pretreatment, the substrate was immersed in a solution of a swelling agent (undiluted solution of product by Okumura Chemical Industries Co., Ltd., trade name "SURF PC-724") at 40° C. for 5 minutes, washed with water and immersed in an aqueous solution containing 600 ml/l of sulfuric acid at 65° C. for 7 minutes. Thereafter the substrate was immersed in an etching solution containing 400 g/l of chromic anhydride and 200 ml/l of sulfuric acid at 70° C. for 3 minutes and washed with water.

Then, the substrate was immersed in an aqueous solution containing 50 ml/l of hydrochloric acid at 25° C. for 2 minutes to effect neutralization treatment. Subsequently the substrate was immersed in a surface modifier (product of Okuno Chemical Industries Co., Ltd., trade name "CONDILYZER SP", aqueous solution containing 150 ml/l of the product) at 40° C. for 4 minutes to achieve conditioning treatment.

Then, the substrate was dipped in an aqueous solution containing 250 ml/l of 35% hydrochloric acid at a solution temperature of 25° C. for 1 minute to conduct a pre-dip treatment. Subsequently the substrate was immersed in a strongly acidic hydrosol solution having a pH adjusted to 1 or less with 320 ml/l of 35% hydrochloric acid and containing 0.4 g/l of palladium sulfate (0.20 g/l of Pd), 27 g/l of stannous chloride (14.2 g/l of Sn) and 3.5 g/l of cupric bromide (1.0 g/l of Cu) (weight ratio of Sn/Pd of 70:1) at a solution temperature of 45° C. for 5 minutes, whereby a hydrosol layer was formed. Subsequently the coated substrate was washed with water.

Thereafter the substrate was immersed in an aqueous alkaline solution containing 45 g/l of potassium hydroxide and 20 g/l of monoethanolamine and having a pH of 13 or more at a solution temperature of 55° C. for 4 minutes. The sol-like electroconductive layer formed in the preceding step was gelled to give a firm electroconductive layer.

After the substrate was washed well with water, it was successively electroplated with copper, nickel and chrome in the same manner as in Example 1 using the same jig as in the preceding step. It took 70 seconds to electroplate the entire surface with copper.

The coatings thus formed by electroplating were free of a rough surface and had a superior appearance.

EXAMPLE 10

An automotive wheel cap made of a polyamide resin (nylon resin manufactured by Toyobo Co., Ltd., grade for electroplating, trade name "T-777-02"), and measuring 38 cm in radius and 23 $dm^2$ in surface area was used as a substrate to be treated. A jig used for electroplating was a stainless steel belt of 12 mm in width and had 6 contact points for contact with the internal surface of the wheel cap. The contact points were spaced away by about 20 cm and had a cross section of 1.5 mm×10 mm.

Then the substrate was immersed in an alkaline degreasing agent (product of Okuno Chemical Industries Co., Ltd., trade name "ACE CLEAN A-220", aqueous solution containing 50 g/l of the product) at a solution temperature of 50° C. for 5 minutes and washed with water. Thereafter the substrate was immersed in an aqueous solution containing 200 g/l of hydrochloric acid and an etching agent (product of Okuno Chemical Industries Co., Ltd., "TN ETCHANT", 200 ml/l) at a solution temperature of 40° C. for 8 minutes and was immersed an aqueous solution containing 60 ml/l of hydrochloric acid at a solution temperature of 250° C. for 2 minutes to achieve etching treatment.

Subsequently the substrate was washed with water and dipped in an aqueous solution containing 250 ml/l of 35% hydrochloric acid at a solution temperature of 25° C. for 1 minute to achieve a pre-dip treatment. Further, the substrate was immersed in the acidic hydrosol solution used in Example 5 at a solution temperature of 40° C. for 5 minutes and washed well with water.

Then the substrate was immersed in the aqueous alkaline solution described in Example 1 at a solution temperature of 50° C. for 5 minutes.

The substrate was then washed well with water, and was successively electroplated in the same manner as in Example 1 with copper, nickel and chrome in this order using the same jig as in the preceding step. It took 90 seconds to electroplate the entire surface with copper.

The coating thus formed by electroplating was free of a rough surface and had a superior appearance.

EXAMPLE 11

A substrate to be treated was a plate of barium titanate ceramics measuring 10 cm×10 cm×0.2 cm (thickness) and having a surface area of about 2 $dm^2$ (product of Sumitomo Special Metals Co., Ltd.). A jig for use in electroplating had 4 contact points for contact with the substrate. The contact points were spaced away by 6 cm (2 locations) and by 10 cm (2 locations). The contact point portion was made of phosphor bronze and had a diameter of 2 mm.

The substrate was immersed in an aqueous solution of an alkaline degreasing agent (product of Okuno Chemical Industries Co., Ltd., aqueous solution containing 50 g/l of "ACE CLEAN A-220") at a solution temperature of 60° C. for 10 minutes, and washed with water.

Thereafter the substrate was immersed in an aqueous solution containing 300 ml/l of 62% nitric acid and 50 ml/l of 55% hydrofluoric acid at a solution temperature of 30° C. for 30 minutes to achieve an etching treatment. Then the substrate was washed with water and immersed in a desmutting agent (product of Okuno Chemical Industries Co., Ltd., trade name "TOP DESMUT TY", aqueous solution containing 250 ml/l of the product) at room temperature for 2 minutes to achieve neutralization. Subsequently the substrate was washed well with water, immersed in a surface modifier (product of Okuno Chemical Industries Co., Ltd., trade name "CONDILYZER SP", aqueous solution of 100 ml/l of the product) at a solution temperature of 40° C. for 3 minutes to achieve surface conditioning treatment and washed well with water.

Then, a pre-dip treatment was carried out by dipping the substrate into an aqueous solution containing 250 ml/l of 35% hydrochloric acid at a solution temperature of 25° C. for 1 minute. The substrate was immersed in the acidic hydrosol solution used in Example 1 at a solution temperature of 45° C. for 5 minutes to form a hydrosol layer and was washed with water.

Thereafter the substrate was immersed in an aqueous alkaline solution containing 20 g/l of potassium hydroxide and 40 g/l of lithium hydroxide and having a pH of 12 or more at a solution temperature of 40° C. for 10 minutes. A firm electroconductive layer was obtained by gelling the hydrosol layer. Then the coated substrate was washed well with water.

Thereafter the substrate was electroplated with nickel using the same jig.

A nickel plating solution was prepared by mixing an aqueous solution containing 250 g/l of nickel sulfate, 50 g/l of nickel chloride and 40 g/l of boric acid with 20 ml/l of ACNA B-1 and 1 ml/l of ACNA B-2 (products of Okuno Chemical Industries) as a brightener. Nickel electroplating was conducted at a plating solution temperature of 50° C. and a current density of 3 $A/dm^2$ using a plate of pure nickel as an anode and the substrate to be plated as a cathode while effecting slow air agitation. It took 55 seconds to electroplate the entire surface of the substrate. The electroplating was continued for 20 minutes under the same conditions to give a nickel coating of about 10 $\mu$m thickness.

The obtained nickel coating was free of blister, a rough surface and like flaws and had an excellent appearance.

We claim:

1. A method of electroplating a non-conductive material, the method comprising the steps of bringing the non-conductive material into contact with an acidic hydrosol solution containing a palladium compound, a stannous compound and a copper compound, bringing the material into contact with an aqueous alkaline solution, and electroplating the material.

2. The method according to claim 1, wherein the acidic hydrosol solution is an aqueous solution containing the palladium compound in an amount of 0.1 to 1.0 g/l calculated as a palladium metal, the stannous compound in an amount of at least 5 g/l calculated as a tin metal, and the copper compound in an amount of 0.2 to 3 g/l calculated as a copper metal at a weight ratio of Sn/Pd of 50–200:1, and having a pH of 1 or less.

3. The method according to claim 1 or 2, wherein the palladium compound in the acidic hydrosol solution is at least one compound selected from the group consisting of palladium chloride, palladium sulfate and palladium acetate; the stannous compound is stannous chloride; and the copper compound is at least one compound selected from the group consisting of copper aliphatic monocarboxylate and copper bromide.

4. The method according to claim 3, wherein the copper aliphatic monocarboxylate is copper formate or copper acetate.

5. The method according to claim 1 or 2, wherein the aqueous alkaline solution is an aqueous one containing at least one compound selected from the group consisting of sodium hydroxide, potassium hydroxide and lithium hydroxide and having a pH of at least 12.

6. The method according to any one of claim 1 or 2, wherein the non-conductive material is a plastic material.

* * * * *